United States Patent [19]

McAdams

[11] Patent Number: 4,603,558

[45] Date of Patent: Aug. 5, 1986

[54] RECEPTACLE FOR MOUNTING IN A FREEZER FOR ASSISTING IN THE DEFROSTING THEREOF

[76] Inventor: Michael J. McAdams, 12 Drumrallagh Estate, Strabane, County Tyrone, Northern Ireland

[21] Appl. No.: 594,360

[22] Filed: Mar. 28, 1984

[30] Foreign Application Priority Data

Mar. 31, 1983 [GB] United Kingdom ..... 8309080

[51] Int. Cl.[4] ..... F25D 21/00

[52] U.S. Cl. ..... 62/272; 62/457; 62/285

[58] Field of Search ..... 62/457, 272, 80, 285

[56] References Cited

U.S. PATENT DOCUMENTS 2,612,761 10/1952 Hilker ..... 62/457

2,986,014 5/1961 Schilling ..... 62/272

*Primary Examiner*—Henry Bennett

*Attorney, Agent, or Firm*—Howard F. Mandelbaum

[57] ABSTRACT

A container or receptacle for a freezer comprises a flexible polymeric material having the shape and contour of the freezer and is adapted to be inserted into and attached to the freezer which may then be used in a conventional manner. Frost builds up on the container rather than on the walls of the freezer. To defrost the freezer, the contents are removed, and the container is removed and replaced with another container; or the removed container is flexed to remove the frost therefrom, and replaced in the freezer.

13 Claims, 13 Drawing Figures

RECEPTACLE FOR MOUNTING IN A FREEZER FOR ASSISTING IN THE DEFROSTING THEREOF

BACKGROUND OF THE INVENTION

The use of freezers in the home and food store is now wide-spread in most developed countries as is the attendant problem of defrosting. This operation is required to be undertaken every two weeks to three months depending upon the relative humidity of the atmosphere and the type and purpose of the equipment in use. For example the defrosting procedure will be required more frequently in open deck display freezers than in those of the closed chest freezer type.

Defrosting, whether it be in the home or food store, is always a wet and messy procedure which, if not accomplished in a short time, can result in severe temperature rises in the frozen food which, if no alternative cold storage is available, can lead to spoilage and health dangers. Many operators remove the food from the freezer to another place and then defrost the freezer with hot water and are thereby left with the task of carrying many buckets of water to a drain which is invariably some distance away; others allow the defrosting to occur naturally at ambient temperature and thereby place the frozen food at risk, while still being faced with the above mentioned problem, i.e., the removal of water to some sink or drain.

SUMMARY OF THE INVENTION

The instant invention overcomes the aforementioned problems by providing a receptacle for mounting in a freezer or for enclosing an evaporator coil thereof characterized in that the receptacle comprises a flexible polymeric material which is contoured and shaped to fit snugly against the walls and base of the freezer or over the evaporator coil thereof and means is provided for releasably retaining the receptacle in situ.

In a first embodiment of the invention, the receptacle is contoured and shaped to form an open-topped container which is adapted to fit snugly against the walls and base of the freezer and wherein there is provided a plurality of openings in the walls of the container in the region of the base thereof for the release of trapped air between the walls of the freezer and the container. The mounting means comprises a hem located in the vicinity of the periphery of the mouth of the container, the hem having a plurality of magnetic elements therein for magnetic attachment to the walls of the freezer to seal the periphery against the walls of the freezer. The hem includes a plurality of pockets and the magnetic elements comprise a plurality of magnetic discs respectively mounted in the pockets.

In another preferred embodiment of the invention, the magnetic means comprises a plurality of magnetic strips mounted in the hem.

In still another preferred embodiment of the invention, the mounting means comprises an adhesive strip located in the vicinity of the periphery of the mouth of the container, the strip having a removable backing tape thereon which strip, in use, adheres to the walls of the freezer to seal the periphery against the walls of the freezer.

In a further embodiment of the invention, the hem is adapted to form a collar which is adapted to fold over the mouth of the freezer.

In a still further embodiment of the invention, the mounting means comprises a collar which is heat sealed or welded to the container, the collar comprising a polymeric material of approximately double the gauge of the material of the container, the collar being adapted to fold over the mouth of the freezer. The collar may also include a hem into which may be inserted magnetic elements for magnetic attachment to the outside walls of the freezer.

In an additional embodiment of the invention, the receptacle is contoured and shaped to form a bag which is adapted to fit snugly over the coil thereof.

In still an additional embodiment of the invention, the mounting means comprises a hem located in the vicinity of the periphery of the mouth of the bag, the hem having a magnetic strip therein for closure of the bag, the bag having an opening for connecting the coil to an associated refrigerator mechanism.

In another embodiment of the invention, the mounting means comprises an adhesive strip located at the mouth of the bag, the strip having a removable backing tape thereon, which strip, in use, is self adhering to close the bag, the bag having an opening for connecting the coil to an associated refrigerator mechanism.

The invention also provides a method for defrosting a freezer which method comprises mounting in the substantially frost-free freezer, a container of the type referred to above, allowing frost to form on the container, removing the container from the freezer, flexing the container to remove the frost therefrom and replacing the container.

Furthermore, the invention provides a method of defrosting the evaporator coil of a freezer which method comprises closing the substantially frost-free evaporator coil with a bag of the type referred to above, allowing frost to form on the bag, removing the bag from the coil, flexing the bag to remove frost therefrom and replacing the bag.

In addition, the invention provides a freezer having a container of the type referred to above, mounted therein.

It has been found that ice, which condenses from the humidity of the atmosphere, will adhere strongly to the polymeric material which may be polyethylene, polypropylene or polyvinylchloride (PVC). The hydrophobic nature of the material is such that it acts almost as a mold-release agent for the frost.

While it is not part of this invention to explain the physics of this phenomenon, it is believed that in the case of initial first deposit from the gaseous water of the atmosphere, the frost is formed from a microscopic water droplet which keys into the surface of the plastic before changing its state to ice. Thereafter, the ice acts as a base on which all subsequent ice deposition can take place.

The polymeric material, natural or colored, may be tailored by heat sealing of joints into a receptacle and it has been found that ice will form on the receptacle instead of the freezer walls and base on which it is contacted or on the evaporator coil as the case may be. After a period of time, for example, when the ice is 2 to 5 cms. thick, the contents of the freezer can be removed and the apparatus then defrosted by simply removing the container therefrom with a strong heave and disposing of the container and ice before the ice melts. Immediately after removing the container, a new container may be inserted into the freezer and the contents returned for continued storage. If desired, the container may be reusable in which case the ice is thrown off the container by flexing the material prior to replacement in the freezer. In a large chest freezer, this defrosting and replacement can be accomplished by a fast worker in three minutes. In case like home freezers, the ice can be dumped out of the container and the same container used over again. In a food store, where labor is costly, it would be more economic and quicker to dump the container with ice thereon and use a new container.

It will be appreciated that where the receptacle is a bag for the evaporator coil, the removal of the food is unnecessary during the defrosting procedure.

It is therefore an object of the invention to provide a container for a refrigerator having a surface to which ice formed from ambient moisture can adhere.

Another object of the invention is to provide a container for a refrigerator which closely conforms to the refrigerated surface of the refrigerator to minimize the ambient air adjacent thereto and thus prevent the formation of ice on said refrigerated surface.

Still another object of the invention to provide a container for a refrigerator which is removably mounted on the refrigerator for ease of disposal of ice formed thereon.

Other and further objects of the invention will be apparent from the following description of several preferred embodiments of the invention in which like reference numerals are used to indicate like parts in the various views.

DESCRIPTION OF THE PREFERRED EMBODIMENTS

Figure 7:
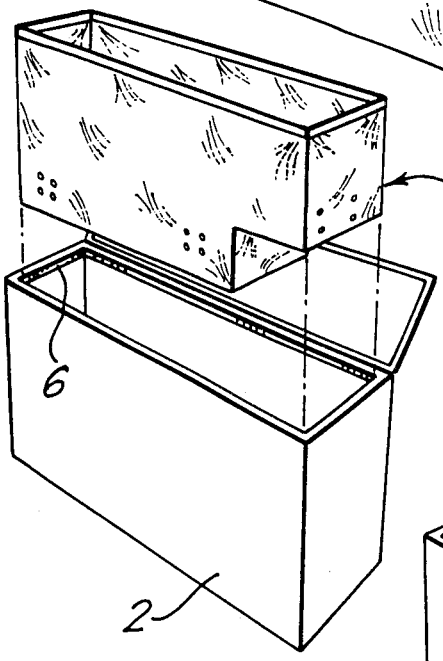
FIG. 7 is an exploded view of a chest freezer and the container of FIG. 6.
Figure 8:
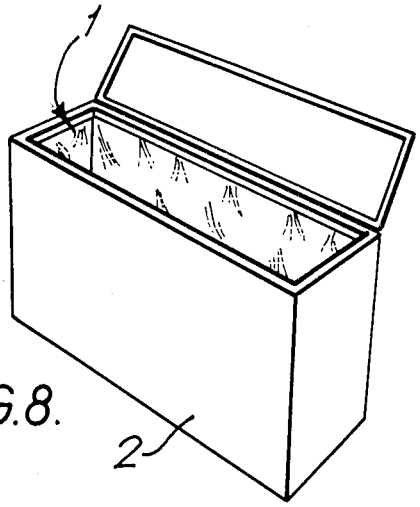
FIG. 8 is a perspective view of the chest freezer of FIG. 7 having the container of FIG. 6 mounted therein.

Referring now to the drawings, there is shown a receptacle 1 according to the invention made from a polymeric material such as strong polythene. The receptacle 1 has the configuration of a chest freezer 2 (FIGS. 7 and 8). In other words, the receptacle 1 is generally an open-topped rectangularly shaped flexible container having an internal step 3 for accommodating the motor compartment and compressor unit (not shown) of the chest freezer 2. In the side walls of the container 1 near the base thereof is a series of small holes 4 the purpose of which will be explained below.

A variety of mounting means for the container 1 are shown in the various drawings.

Figure 1:
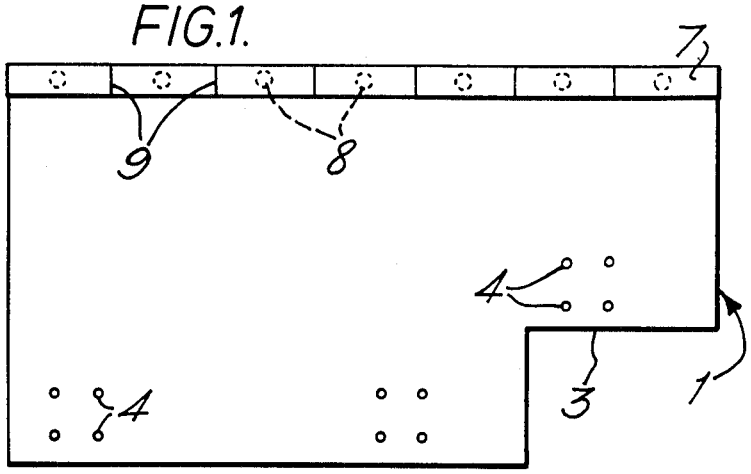
FIG. 1 is a side elevation of a receptacle or container according to the invention showing a first mounting means.

Thus, in the case of the container 1 of FIG. 1, there is provided a hem 7 into which may be inserted a plurality of magnetic discs 8. To retain the magnetic discs 8 in spaced apart relationship, a plurality of seams 9 is provided which provide pockets for each of the discs 8.

Figure 2:
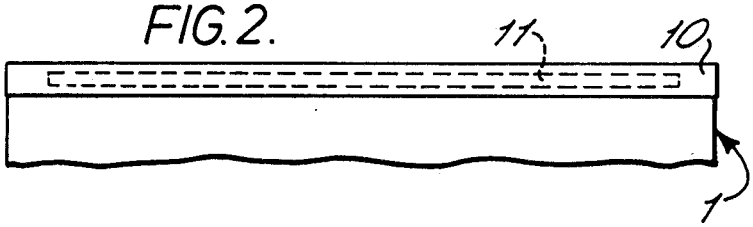
FIG. 2 is a partial side elevation of a container according to the invention showing a second mounting means.

In the embodiment shown in FIG. 2, each edge of the container 1 has a hem 10 into which is threaded a magnetic strip 11.

Figure 3:
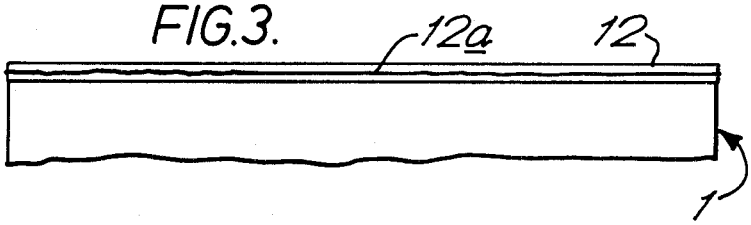
FIG. 3 is a partial side elevation of a container according to the invention showing a third mounting means.

The container 1 may be adapted to fold over the edge of the freezer in the form of a collar 12 and, as shown in FIG. 3, an elastic band 12*a* may be used to retain the collar 12 of the container 1 against the freezer's external walls.

Figure 4:
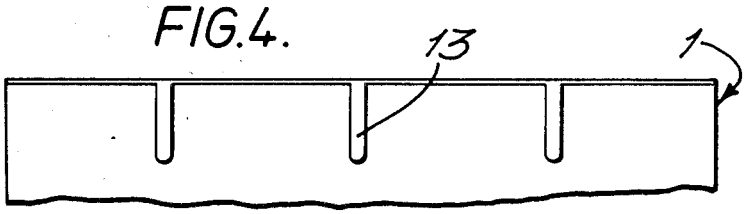
FIG. 4 is a partial side elevation of a container according to the invention showing a fourth mounting means.

Alternatively, as shown in FIG. 4, a plurality of flaps 13 may be attached by heat sealing or welding to the container 1 which flaps 13 enable the container 1 to be hung from the upper edge of the freezer.

Figure 9:
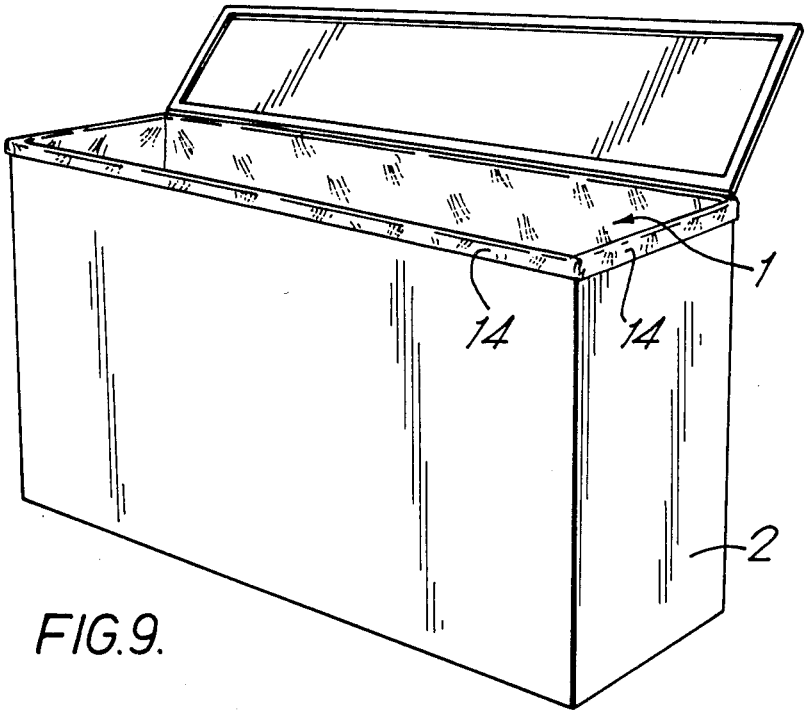
FIG. 9 is a perspective view of a second chest therein which container has a sixth mounting means.

In FIG. 9 of the drawings, a further variation of attachment is shown in which a hem 14 is made in the container 1 in a manner similar to the hem 7 of FIG. 2, and a magnetic strip is inserted into the hem 14 of each wall of the container 1. However, in placing the container 1 in the freezer 2, the hem 14 is turned over on itself to form a collar which rests over the edge of the freezer 2 and the magnetic strips engage with the metallic surface on the outside walls of the freezer 2.

It has been estimated that of all the freezers on sale which have non-ferrous internal sides and bases, about 40% have a ferrous rim 6 immediately inside the top of each side.

Figure 10:
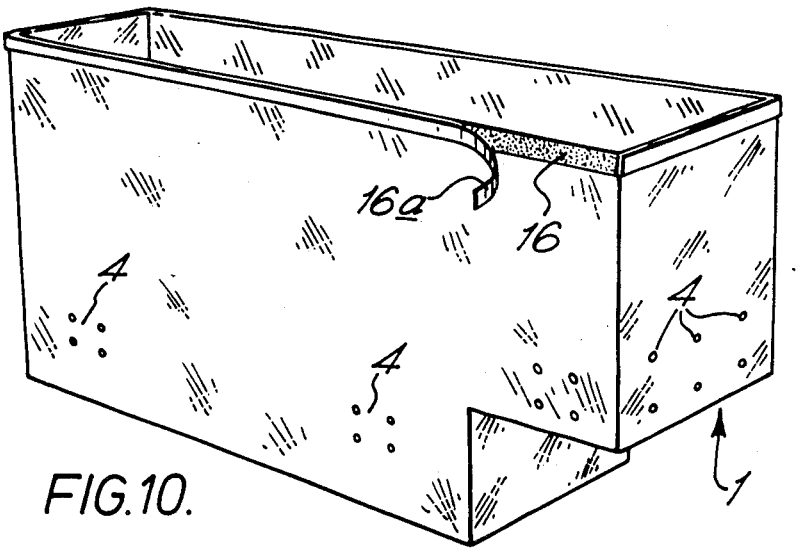
FIG. 10 is a perspective view of a container according to the invention having a seventh mounting means.

With respect to FIG. 10 of the drawings, in freezers such as ice-cream cabinets having sliding doors at the mouth thereof and without a magnetic interior, an adhesive strip 16 is provided on the outside of the container 1 which strip 16 adheres to the inner wall of the freezer. A backing tape 16*a* is provided which is in place over the strip 16 prior to use but which tape 16*a* may be pulled back to reveal the adhesive strip 16.

Figure 5:
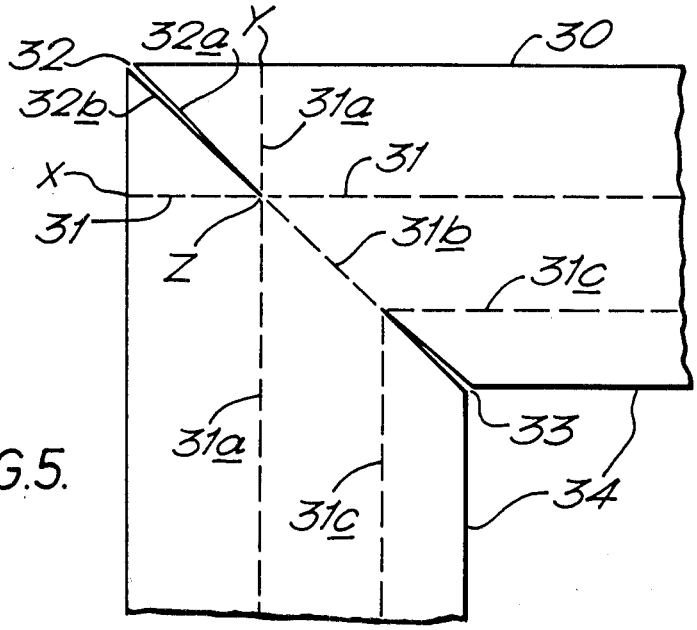
FIG. 5 is a plan view of part of a collar, being a fifth mounting means, for attachment to a container according to the invention.
Figure 5A:
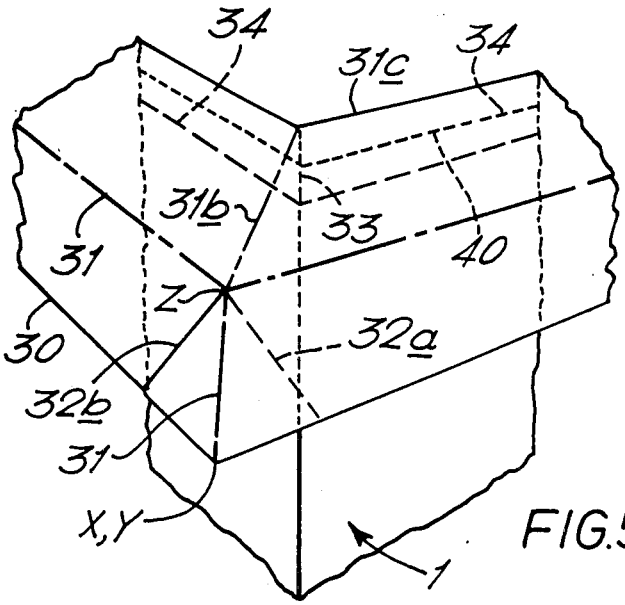
FIG. 5*a* is a perspective view of the collar of FIG. 5 attached to a container according to the invention.
Figure 6:
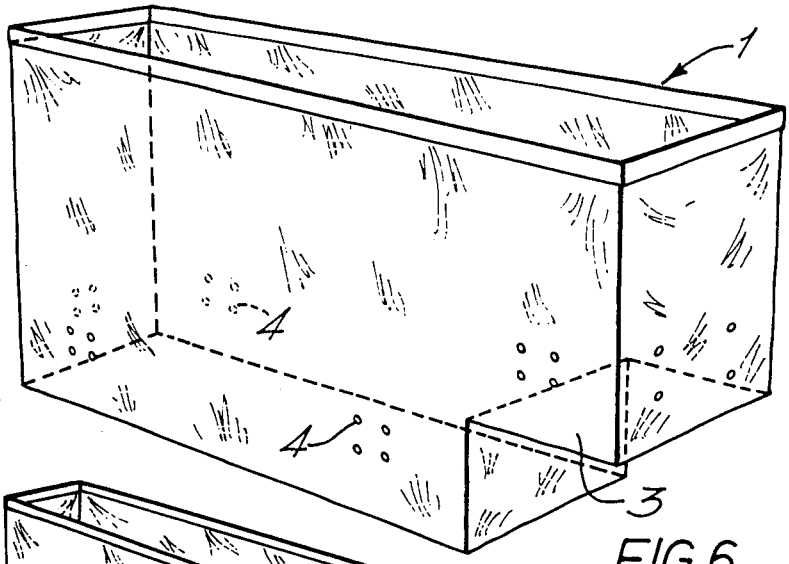
FIG. 6 is a perspective view of the container of FIG. 2.

A further mounting means is shown in FIGS. 5 and 5*a*. In FIG. 5 there is shown a plan view part of a collar 30. The collar 30 preferably comprises a polymeric material of the same type as the container 1 but of double gauge thickness. To enable the collar 30 to fold over the mouth of the freezer, and particularly at the corner edges thereof, fold lines 31, 31*a*, 31*b*, 31*c* are generated in the collar 30 and then two slits 32 and 33 are made in the corner edge of the collar as shown in FIG. 5. The slit 32 generates two edges 32*a* and 32*b*. As the collar 30 is folded on the fold lines 31, 31*a*, the edge 32*a* is passed under the edge 32*b* until the material between the fold lines 31, 31*a* between the points marked X, Y, and Z overlap. In other words, that part of the fold line 31 between the points X and Z is coincident with that part of the fold line 31*a* between Y and Z. The material overlapping is then heat sealed or welded to form a corner as shown in FIG. 5*a*. By heat sealing or welding that part of collar 30 between the fold lines 31*c* and the edge 34 of the collar 30 to a container 1, the edge 40 of which container 1 is shown in FIG. 5*a*, the collar 30 provides a secure mounting for the container 1 on the freezer. If desired, the collar 30 may also have a hem (not shown) as described above which hem contains magnetic elements for magnetic attachment to the walls of the freezer.

Regardless of the method of mounting the container 1 in the freezer, it is important that at the periphery of the container 1, there should be intimate contact between the container 1 and the walls of the freezer 2. It is desirable that there should be little or no air barrier between the inner walls of the freezer 2 and the outside of the container 1 when in situ. If such a barrier is present, then the efficiency of the freezer 2 and its ability to freeze and preserve food stored in the container 1 will be significantly impaired. The provision of the holes 4 enables air which is trapped in the space between the container 1 and the walls of the freezer 2 to escape into the atmosphere when frozen (or fresh) food is placed in the container 1. Thus, the walls and bases of the container 1 are in intimate contact with the walls and bases respectively of the freezer 2 and consequently, frost does not build-up between the walls of the freezer 2 and the container 1.

However, frost will build-up on the walls of the container 1 and to effectively defrost the freezer 2, the frozen food is removed, and the container 1 is lifted from the freezer 2. The frost can easily be flexed off the walls of the container 1 and deposited in solid form at a suitable location where it subsequently melts and causes no problems to the user. The container 1 is immediately re-inserted into the freezer 2 and the food replaced. The time taken to defrost the freezer can be made in minutes rather than in hours as heretofore.

It may be desirable, in commercial freezers, to dispose of the container 1 and replace it with a new container. In the case of the container 1 having the magnetic strip (FIGS. 2, 5, or 9), the hem thereof could be designed so that the magnetic strip could be removed therefrom and inserted into the hem of the new container thereby keeping costs to a minimum.

Figure 11:
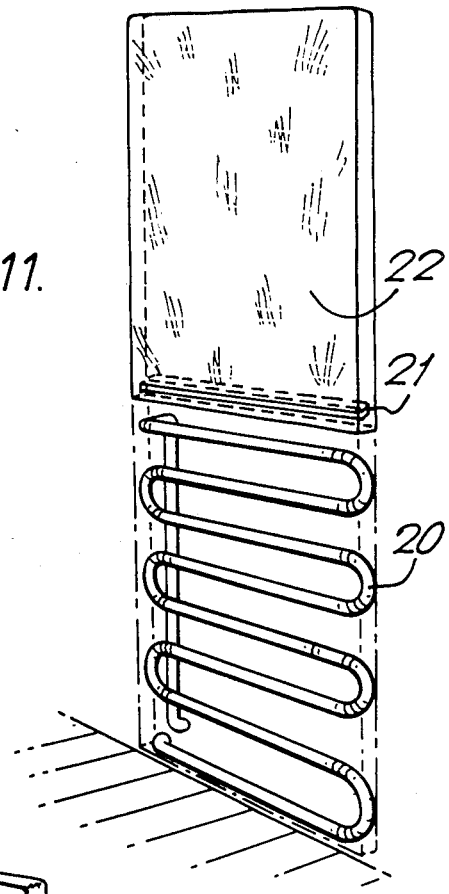
FIG. 11 is an exploded view of an evaporator coil of a cold room or transport refrigerator and a receptacle or bag according to the invention.
Figure 12:
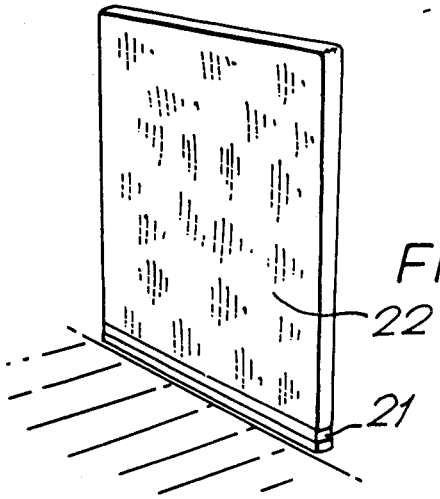
FIG. 12 shows the evaporator coil and the bag of FIG. 11 in use.

In the case of cold rooms and refrigerated containers on vehicles, it would not be possible to line the walls of the room or container with a container of the type referred to above due to the relatively high cost. In cold rooms and refrigerated containers of this type, an evaporator coil(s) 20 is usually mounted on one or more walls of the room or refrigerated container as shown in FIGS. 11 and 12. Heretofore, ice which formed on the coil 20 had to be chipped off or the cold room taken out of service to defrost the coil 20. By simply covering the coil 20 with a receptacle or bag 22 according to the invention as shown in FIG. 11 or 12, the frost will accumulate on the outside of the bag 22 rather than on the coil 20 in a manner similar to the container 1 previously described. By providing appropriate sealing means in the form of a magnetic strip 21, no air circulation will take place inside the bag 2 and if the bag 22 is made to just fit the coil 20, the quantity of trapped air in the jacket will be reduced to a minimum. Thus, to effectively defrost the coil 20, the bag 22 is shaken to deposit the ice on the floor of the cold room or container which ice can easily be gathered or swept away to melt later. Alternatively, the bag 22 may be lifted off the coil 20 and replaced by a new bag according to the invention if desired.

It is to be appreciated that the foregoing is a description of several preferred embodiments of the invention to which alterations, variations and modifications can be made without departing from the spirit and scope of the invention which is set forth in the following claims. For example, a variety of mounting means other than those described may be used to seal the container 1 against the walls of the freezer 2 or to close the bag 22.

What is claimed is:

1. Refrigeration defrosting apparatus comprising
cooling means having a surface adapted to have its temperature lowered by a refrigeration process,
liner means removably mounted adjacent said cooling means and having a first surface snugly conformable to said cooling means surface and an opposite surface adapted to receive frost resulting from said lowered temperature, and
means for removably connecting said liner means to said cooling means, said liner means substantially covering said cooling means surface to prevent communication between said cooling means surface and ambient air, whereby ice resulting from condensation of water vapor in the ambient air is formed on said opposite surface of said liner means.

2. Refrigeration apparatus according to claim 1 wherein said liner means is formed from a polymer film.

3. Refrigeration apparatus according to claim 2 wherein said polymer film is selected from the group consisting of polythene, polypropylene, and polyvinylchloride.

4. Refrigeration apparatus according to claim 1 wherein said cooling means is in the shape of a storage chest and said cooling means surface is an inner surface of said chest adapted to maintain at a subambient temperature articles stored therein, and said liner conforms substantially to the shape of said cooling means for receiving said articles.

5. Refrigeration apparatus according to claim 1 wherein said cooling means includes a ferrous element and said connecting means comprises a magnet mounted on said liner means for attraction to said ferrous element.

6. Refrigeration apparatus according to claim 5 wherein said connecting means comprises a plurality of disc magnets set into a seam on said liner means.

7. Refrigeration apparatus according to claim 5 wherein said connecting means comprises a magnetic strip mounted on said liner means.

8. Refrigeration apparatus according to claim 1 wherein said connecting means comprises an elastic band mounted on said cooling means and adapted to circumscribe said liner means.

9. Refrigeration apparatus according to claim 1 wherein said connecting means comprises a deposit of an adhesive on an outer surface of said liner means adapted to engage said cooling means when said liner means is mounted thereon.

10. Refrigeration apparatus according to claim 9 wherein said liner means comprises a plurality of adhesive strips mounted in spaced relationship on the outer surface thereof.

11. Refrigeration apparatus according to claim 1 wherein said liner means has an aperture adjacent a corner thereof adapted to overlie a corner of said cooling means.

12. Refrigeration apparatus according to claim 1 wherein the cooling surface of said cooling means is an outer surface and said liner means has an interior surface shaped to conform to said cooling means outer surface when said liner means is inserted on said cooling means.

13. Refrigeration apparatus according to claim 12 wherein said cooling means comprises a coil and said liner means comprises a bag adapted to be snugly received on said coil.

* * * * *